US009161575B1

(12) United States Patent
Kramer

(10) Patent No.: US 9,161,575 B1
(45) Date of Patent: Oct. 20, 2015

(54) PANTS, REPLACEABLE KNEE PANELS, AND PANTS HAVING THE SAME

(71) Applicant: Tonya Kramer, Chippewa Falls, WI (US)

(72) Inventor: Tonya Kramer, Chippewa Falls, WI (US)

( * ) Notice: Subject to any disclaimer, the term of this patent is extended or adjusted under 35 U.S.C. 154(b) by 0 days.

(21) Appl. No.: 13/974,941

(22) Filed: Aug. 23, 2013

(51) Int. Cl.
*A41D 1/06* (2006.01)
*A41D 13/06* (2006.01)
*A41D 13/00* (2006.01)

(52) U.S. Cl.
CPC ..... *A41D 1/06* (2013.01)

(58) Field of Classification Search
CPC ..... A41D 13/065; A41D 13/0575; A41D 13/0593; A41D 17/02; A41D 13/0568; A41D 13/0556; A41D 13/0562; A41D 19/0051; A41D 1/06; A41D 27/20; A41D 13/00; A41D 13/05; A41D 13/0543; A41D 27/12; A41D 13/0153; A41D 15/00; A41D 17/00; A41D 1/08; A41D 1/082; A41D 1/086; A41D 2300/30; A41D 2400/70; A41D 2600/20; G09F 21/02; G09F 23/0066; Y10S 2/911; Y10S 2/919
See application file for complete search history.

(56) References Cited

U.S. PATENT DOCUMENTS

| | | | | | |
|---|---|---|---|---|---|
| 514,576 | A | * | 2/1894 | Walther | 2/231 |
| 1,749,231 | A | * | 3/1930 | Sager | 36/2 B |
| 1,749,789 | A | * | 3/1930 | Wheeler | 36/2 B |
| 1,922,172 | A | * | 8/1933 | Nilsen | 36/2 B |
| 2,431,287 | A | * | 11/1947 | Washington | 2/239 |
| 2,568,083 | A | * | 9/1951 | Mitchell | 2/231 |
| 2,835,990 | A | * | 5/1958 | Lang, Sr. | 36/2 R |
| 3,168,746 | A | * | 2/1965 | Smith | 2/24 |
| 3,191,185 | A | * | 6/1965 | Martin | 2/22 |
| 3,346,877 | A | * | 10/1967 | Zirves | 2/24 |
| 4,561,123 | A | * | 12/1985 | Hull | 2/23 |
| 4,561,124 | A | * | 12/1985 | Thompson | 2/23 |
| 4,613,991 | A | * | 9/1986 | Grover | 2/23 |
| 4,622,697 | A | * | 11/1986 | Tajima | 2/23 |
| 4,805,239 | A | * | 2/1989 | Ciago | 2/24 |
| 5,033,126 | A | * | 7/1991 | Wruck et al. | 2/242 |
| D321,969 | S | * | 12/1991 | Upthegrove et al. | D2/860 |
| 5,076,043 | A | * | 12/1991 | Butler | 119/850 |
| 5,170,503 | A | * | 12/1992 | Hightower et al. | 2/22 |
| 5,173,967 | A | * | 12/1992 | Carter | 2/242 |
| D334,827 | S | * | 4/1993 | Brown | D29/121.1 |
| D335,000 | S | * | 4/1993 | Johnson | D29/121.1 |
| 5,611,081 | A | * | 3/1997 | Torres | 2/23 |
| 5,673,836 | A | * | 10/1997 | Bush | 224/576 |
| 5,729,832 | A | * | 3/1998 | Grilliot et al. | 2/23 |
| 5,732,412 | A | * | 3/1998 | Holden | 2/23 |
| 5,920,902 | A | * | 7/1999 | Crampton | 2/24 |
| 6,115,838 | A | * | 9/2000 | Scholtis et al. | 2/46 |
| 6,347,405 | B1 | * | 2/2002 | Boyko | 2/62 |
| 6,425,135 | B1 | * | 7/2002 | Aldrich | 2/23 |
| 37,681 | A1 | * | 1/2003 | Boersema | 2/69 |
| 6,751,804 | B1 | * | 6/2004 | Warner et al. | 2/23 |

(Continued)

*Primary Examiner* — Bobby Muromoto, Jr.
(74) *Attorney, Agent, or Firm* — Anthony J. Bourget

(57) ABSTRACT

A pair of pants and replacement panels for use with the pants where a pant leg having a generally tubular configuration extends from a trunk portion of the pants, the pant leg defining a gap extending from an above-the-knee area of the pant leg to a terminal end of the pant leg, the gap originates from a position above a half-way position of the pant leg where the half-way position is measured along an inseam of the pant leg to be halfway from the terminal end of the pant leg to a crotch of the pant leg. Each leg of the pants may define a gap and each leg may be configured to have a panel connected to the leg to cover the gap.

26 Claims, 8 Drawing Sheets

(56) References Cited

U.S. PATENT DOCUMENTS

| | | | | |
|---|---|---|---|---|
| 7,216,370 | B1 * | 5/2007 | Warner et al. | 2/23 |
| 7,296,301 | B1 * | 11/2007 | Conn | 2/24 |
| 7,415,733 | B2 * | 8/2008 | Rampersad | 2/23 |
| 7,712,150 | B2 * | 5/2010 | Pardillo et al. | 2/23 |
| 7,725,951 | B2 * | 6/2010 | Rampersad | 2/24 |
| 7,945,968 | B2 * | 5/2011 | Johnson | 2/23 |
| 8,407,813 | B2 * | 4/2013 | Grilliot et al. | 2/227 |
| 8,438,667 | B2 * | 5/2013 | Grogro et al. | 2/228 |
| 8,656,514 | B2 * | 2/2014 | Neuron | 2/23 |
| 8,683,618 | B2 * | 4/2014 | Grogro et al. | 2/228 |
| 8,719,965 | B2 * | 5/2014 | Turner et al. | 2/228 |
| 2004/0143887 | A1 * | 7/2004 | Durkin et al. | 2/267 |
| 2005/0050607 | A1 * | 3/2005 | Myers | 2/69 |
| 2005/0268370 | A1 * | 12/2005 | Frieler et al. | 2/24 |
| 2006/0010576 | A1 * | 1/2006 | Tse et al. | 2/244 |
| 2011/0289651 | A1 * | 12/2011 | Clark | 2/161.1 |
| 2012/0073029 | A1 * | 3/2012 | Clark | 2/161.1 |

* cited by examiner

PANTS, REPLACEABLE KNEE PANELS, AND PANTS HAVING THE SAME

BACKGROUND OF THE INVENTION

1. Field of the Invention

The present invention relates to pants and removable and replaceable panels or patches for clothing items and more particularly to detachable knee patches or covers for snow pants.

2. Background Information

There have been many knee patch devices developed over the years. Some examples may be found in various patents, such as devices found in U.S. Pat. Nos. 4,622,697, 2,568,083, 6,347,405, 7,296,301, and 7,216,370. While these and other devices or systems may have useful features, there is room for improvement.

SUMMARY OF THE INVENTION

Heretofore designs of pants or snow pants utilizing patches or panels to cover defects of the pants or for other purposes did not include panels or fastening means that operate at a terminal end of the pants or that include an operating or connecting means that traverses the leg at a position above the knee area, among other features.

One aspect of the invention comprises a removable panel or removable panels or patches for pants, and particularly for snow pants. The detachable panels extend from above the pant knee area to the terminal end of each pant leg and are attached by a slide fastener (i.e., a zipper) on the top and along the sides of the panel and/or use hook-and-loop fasteners on the sides and/or top of the panel. In one aspect a panel comprises the outer layer of the snow pants. A single zipper originates at a terminal end (or near a terminal end) of the leg and zips upward and then curves horizontally across the pant leg at or above the knee area and then curves downward to terminate at the terminal end (or near the terminal end) of the pant leg. In one aspect, the panel comprises a top layer of the pant leg which allows a person to remove the panel and wear the pants as normal (of course with the outer layer removed and with receiving zipper features concealed under a flap or flaps). The panel may or may not conceal defects in the underlying pant leg.

Another aspect of the invention comprises a replacement panel (i.e., removing the panel exposes the interior or leg of the pants wearer). The panel in this aspect may include multiple layers (i.e., insulation, front and back layers) to correspond with the snow pants. The panel includes a connecting means such as a panel slide fastener component that aligns around the perimeter edge of the panel except along a terminal end of the panel which generally aligns with a terminal end of the pant leg.

A further aspect of the invention includes pants configured to receive a panel where each leg of the pants include a gap and having connecting means to secure a panel to cover the gap. The gap runs from a position above-the-knee area of the leg to a terminal end of the leg. In one aspect the pant leg includes an original pant material at a front side of the leg and the panel covers the original pant material and also fills the gap.

In a further aspect of the invention panels may come in pairs and display a unitary image such that when the knees of the pant legs are positioned adjacently the unitary image is shown. The panels are also configured to be interchangeable from pants to pants and leg to leg and to include any desired colors or design schemes or image objects. The panels may be displayed and/or sold separately as accessories of pants or included with pants for display and sale.

In a method aspect, a user may replace panels as desired by unfastening the panel from a pant leg and inserting a different panel by fastening. Fastening may occur via zipping a panel onto a zipper component of the pants. A single zipper may be utilized which begins and ends adjacent a terminal end of the pants and is oriented such that it passes transverse the pant leg at a position above the knee area of the pant leg.

The above partial summary of the present invention is not intended to describe each illustrated embodiment, aspect, or every implementation of the present invention. The figures and detailed description and claims that follow more particularly exemplify these and other embodiments and further aspects of the invention.

BRIEF DESCRIPTION OF THE DRAWINGS

The invention may be more completely understood in consideration of the following description of various embodiments of the invention in connection with the accompanying drawings, in which.

Figure 1:
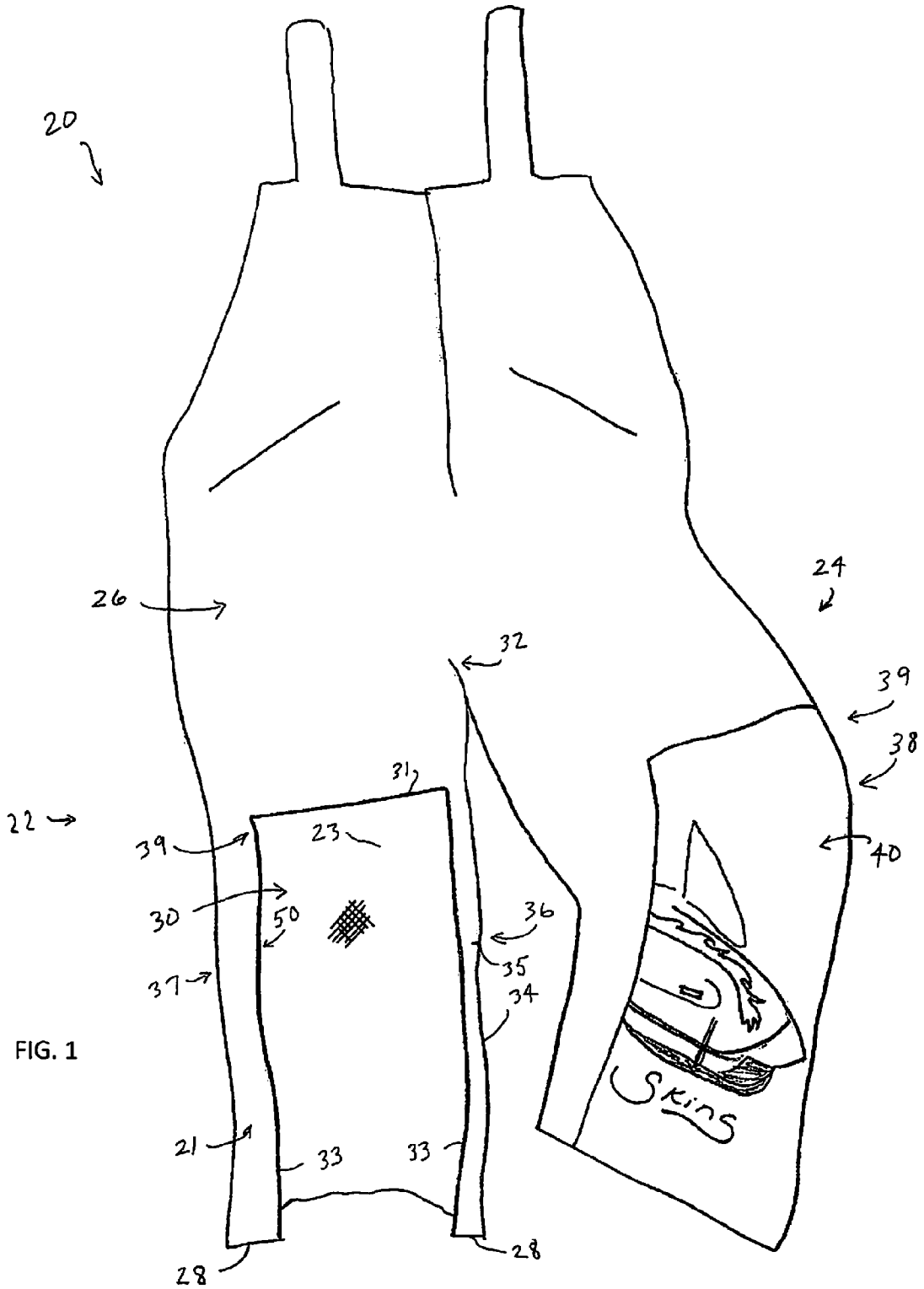
FIG. 1 is a front view of a garment in accordance with an aspect of the present invention.

While the invention is amenable to various modifications and alternative forms, specifics thereof have been shown by way of example in the drawings and will be described in detail. It should be understood, however, that the intention is not necessarily to limit the invention to the particular embodiments, aspects and features described. The intention is to cover all modifications, equivalents, and alternatives falling within the spirit and scope of the invention and as defined by the appended claims.

DETAILED DESCRIPTION OF THE INVENTION

Figure 2:
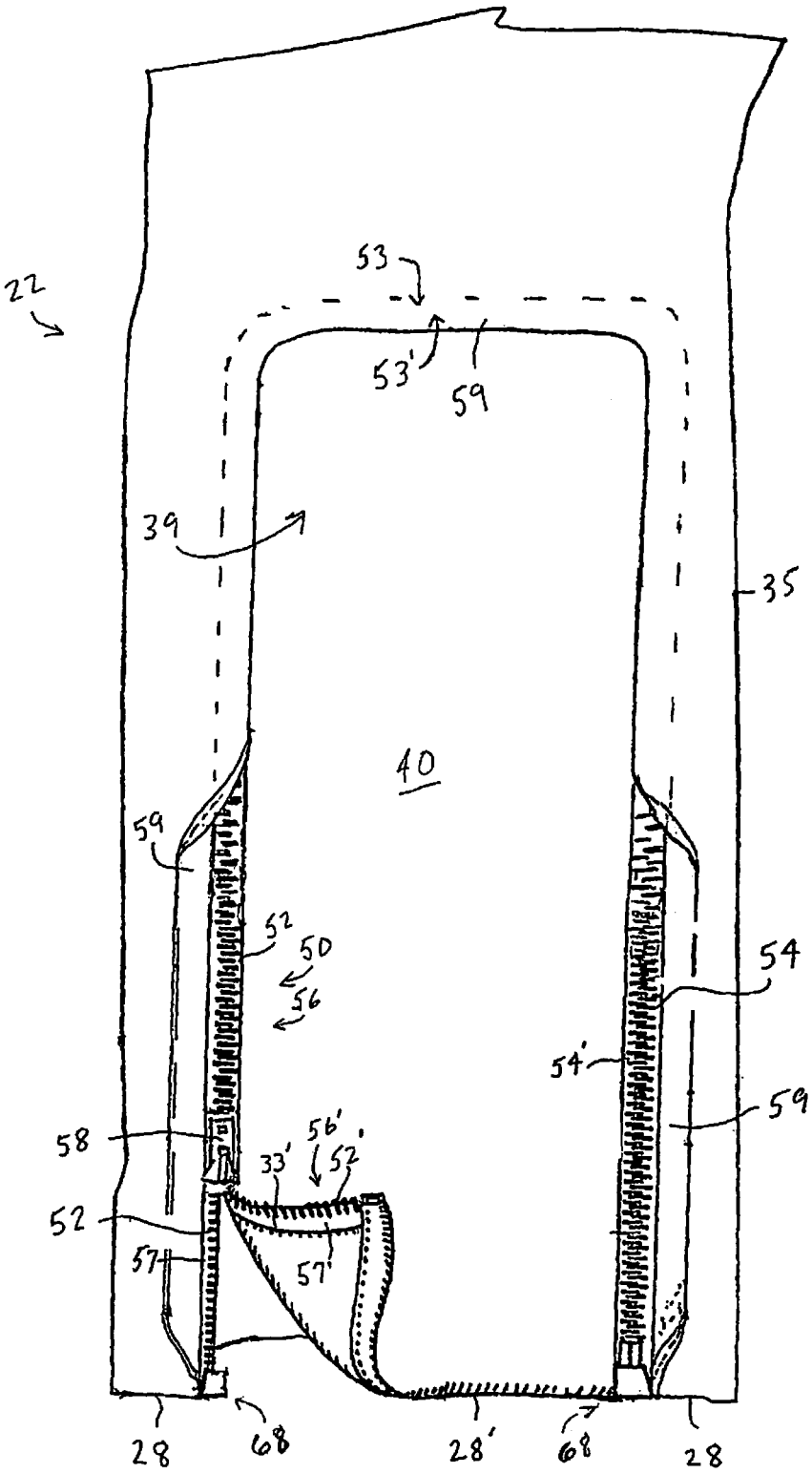
FIG. 2 is a partial front view of a further aspect of the invention.

Referring to FIGS. 1-8, aspects of the pants, replaceable knee panels, pants having replaceable knee panels, and method aspects of the invention are shown. Referring to FIG. 1 and FIG. 2, pants 20 includes a first leg 22 and a second leg 24 extending from a trunk portion 26. Pants 20 are configured to be worn as typical pants, where the user inserts one leg into first leg 22 and another leg into second leg 24. Legs 22, 24 have a generally tubular configuration. Pants 20 may be made of any desired clothing material for normal wear, and can also be constructed for specialty purposes with many different types of materials. In one aspect pants 20 may be a snow pant or bib overall style snow pant, or other sporting apparel. In other aspects pants 20 may be a general pair of pants. In further aspects a pant leg may also comprise an arm sleeve or other clothing or apparel item.

In one aspect leg 22 and leg 24 are symmetrical. Reference to features of leg 22 also applies to features of leg 24, and vice versa. Pant leg 22 defines a gap 30. Gap 30 originates at a position above a knee area of leg 22. Particularly, knee area 38 corresponds with a general location of where a user's knee would be or is positioned within pant leg 22, 24. In one instance, gap 30 originates at an above-the-knee area 39 which is located above knee area 38. It may be appreciated that above-the-knee area 39 is positioned at least above a half-mark 35 of leg 22. Half-mark 35 is measured to be halfway from terminal end 28 of leg 22 to crotch 32. Half-mark 35 is measured along an inseam 34 of leg 22. While inseam 34 may correspond to an actual seam of leg 22, inseam 34 is intended to reference the most medial aspect of leg 22 whether or not a seam is located at that position. Crotch 32 is a where leg 22 and leg 24 meet (or the general area where legs converge if they do not actually meet). Gap 30 extends from an upper gap edge 31 to a terminal end 28 of leg 22. Gap 30 is positioned on a front side of leg 22. As may be appreciated with respect to FIG. 1, material of a back side 23 of leg 22 is visible when looking through gap 30 from a front view.

In one aspect gap 30 is defined by a perimeter edge 33 of pant 22. In one example, perimeter edge 33 spans from terminal end 28 upward to upper gap edge 31, traverses along gap edge 31 and then spans downward to terminal end 28. With reference to FIG. 1, for example, perimeter edge 33 travels in a generally U-shaped or partial rectangular shaped pattern. It may be appreciated that perimeter edge 33 may be configured in a variety of patterns.

Leg 22 includes connecting means 50 for connecting a panel 40 to leg 22. In one aspect connecting means 50 includes a slide fastener component 56 (See also FIG. 2). In one example fastener component 56 is a zipper half 57. Alternate fastener components 56 may be used such as hook-and-loop fasteners, snaps, buttons, clasps or other fasteners. Such components may be aligned along leg 22 and generally about a perimeter of gap 30. Fastener component 56 is secured to perimeter edge 33. In one example a first portion 52 of fastener component 56 is oriented generally vertically on pant leg 22. A second portion 53 of component 56 may be oriented generally transverse first portion 52. Second portion 53 in one example extends between a medial portion 36 of leg 22 and a lateral portion 37 of leg 22. A third portion 54 of component 56 is oriented generally vertically on leg 22 and generally transverse with respect to second portion 53. First portion 52, second portion 53 and third portion 54 comprise a continuous component 56. In FIG. 2 component 56 has a generally U-shaped pattern with rounded corners at about 90 degrees. It may be appreciated that different corner patterns such as ovals or triangular or other patterns may be used. It may be appreciated that a variety of variations in the orientations or patterns may be used for component 56 and perimeter 33.

As shown in FIG. 2, leg 22 includes a panel 40 configured to connect to leg 22 in order to fill gap 30. Panel 40 may be made of the same or similar material as that used for leg 22, or may be comprised of different material as desired. In one instance panel 40 will comprise a three-ply insulated material to match a three-ply insulated material of leg 22. It may be appreciated that panel 40 (and pants 20) may also be made of single ply material (and/or multiply layers of materials). A panel 40 may also be used to fill gap 30 of leg 24. Panels 40 may be interchangeable between legs 22, 24.

Connecting means 50 and pant slide fastener component 56 are configured to allow engagement between leg 22 and panel 40 (or connection of panel 40 to leg 22). Panel 40 includes connecting means 50' for connecting panel 40 to leg 22. In one aspect connecting means 50' includes a panel slide fastener component 56'. In one example fastener component 56' is a zipper half 57'. Alternate fastener components 56' may be used such as hook-and-loop fasteners, snaps, buttons, clasps or other fasteners. Fastener component 56' is secured to a perimeter edge 33' of panel 40. In one example a first portion 52' of fastener component 56 is oriented generally vertically on panel 40. A second portion 53' of component 56' may be oriented generally transverse first portion 52'. When panel 40 is connected to leg 22, second portion 53' in one example extends between a medial portion 36 of leg 22 and a lateral portion 37 of leg 22. A third portion 54' of component 56' is oriented generally vertically on panel 40 and generally transverse with respect to second portion 53'. It may be appreciated that a variety of variations in the orientations or patterns may be used for component 56' and perimeter 33'. It may be appreciated that fastener component may connect to perimeter edge 33 to span the perimeter of panel 40 except for a portion of panel 40 at terminal end 28'. The portion that is void of a fastener component prevents component 56' from contact the ground or being exposed where it might otherwise come into contact with a user's leg. It may be appreciated that panel 40 connects to leg 22 via connecting means 50, 50'. Particularly, fastener component 56' connects with fastener component 56. More particularly, zipper half 57 connects with zipper half 57'. In one instance zipper half 57' may comprise a small plastic zipper material that can be curved or shaped to align in a variety of orientations as desired.

Operating member 58 may be used to operate the connection/detachment of zipper halves 57, 57'. A user may slide operating member 58 to secure panel 40 to leg 22 to cover gap 30. Particularly, in one aspect operating member 58 will cause pant slide fastener component 56 to engage with panel slide fastener component 56'. More particularly, sliding member 58 will cause first portion 52 to engage with first portion 52', second portion 53 to engage with second portion 53', and third portion 54 to engage with first portion 54'. Operating member 58 may be used in reverse to remove panel 40 from leg 22. In one aspect operating member 58 is configured to stop in a zipped position at the lateral portion 57 of leg 22. Configuring operating member 58 to stop at a lateral portion 57 reduces potential contact with leg 24. In an alternative arrangement operating member may be positioned to stop in a zipped position at the medial portion 36 of leg 22. A user may opt to replace panel 40 with a new panel 40 equipped with compatible connecting means 50' (or reverse the existing panel 40 on the same leg 22 as desired). In this manner a user who has worn a hole in the knees (actually, worn a hole in panel 40) of his or her pants 20 may replace the worn area by replacement of panel 40.

In one aspect operating member 58 may originate at a fastener component 56 which is positioned at a corner area 68. Slide fastener component 56 may span from corner area 68 at lateral portion 37 of leg 22 to a corner area 68 at medial portion 36 of leg 22. In one aspect component 56 spans from terminal end 28 at corner area 68 to terminal end 28 at corner area of medial portion 36 of leg 22.

A flap 59 may be used to cover component 56, 56' as desired. Operating member 58 may also be concealed under flap 59 and a pocket can be configured so that member 58 does not easily activate or extend into view.

It may be appreciated that positioning or orienting second portion 53, 53' of fastener component 56 at the above-the-knee area 39 removes portion 53, 53' from an area of leg 22 that is prone to repeated contact. Such positioning also inhibits a user from kneeling on portion 53, 53' which might otherwise cause harm to the user's leg or knee.

In operation a user may attend to removal and replacement of a panel 40 or panels 40. Use of a single operating member 57 allows a user to unzip panel 40 from leg 22. Thereafter the user may insert a new panel 40 by using the same zipping technique in reverse. Orienting the connecting means 50 and/or fastener component 56 to terminate at terminal end 28 allows for efficient connection and removal of panel 40. A person, including a child, can attend to the operation because it is located at the terminal end 28 of leg 22. Such orientation allows for ready access to operating member 57.

Figure 3:
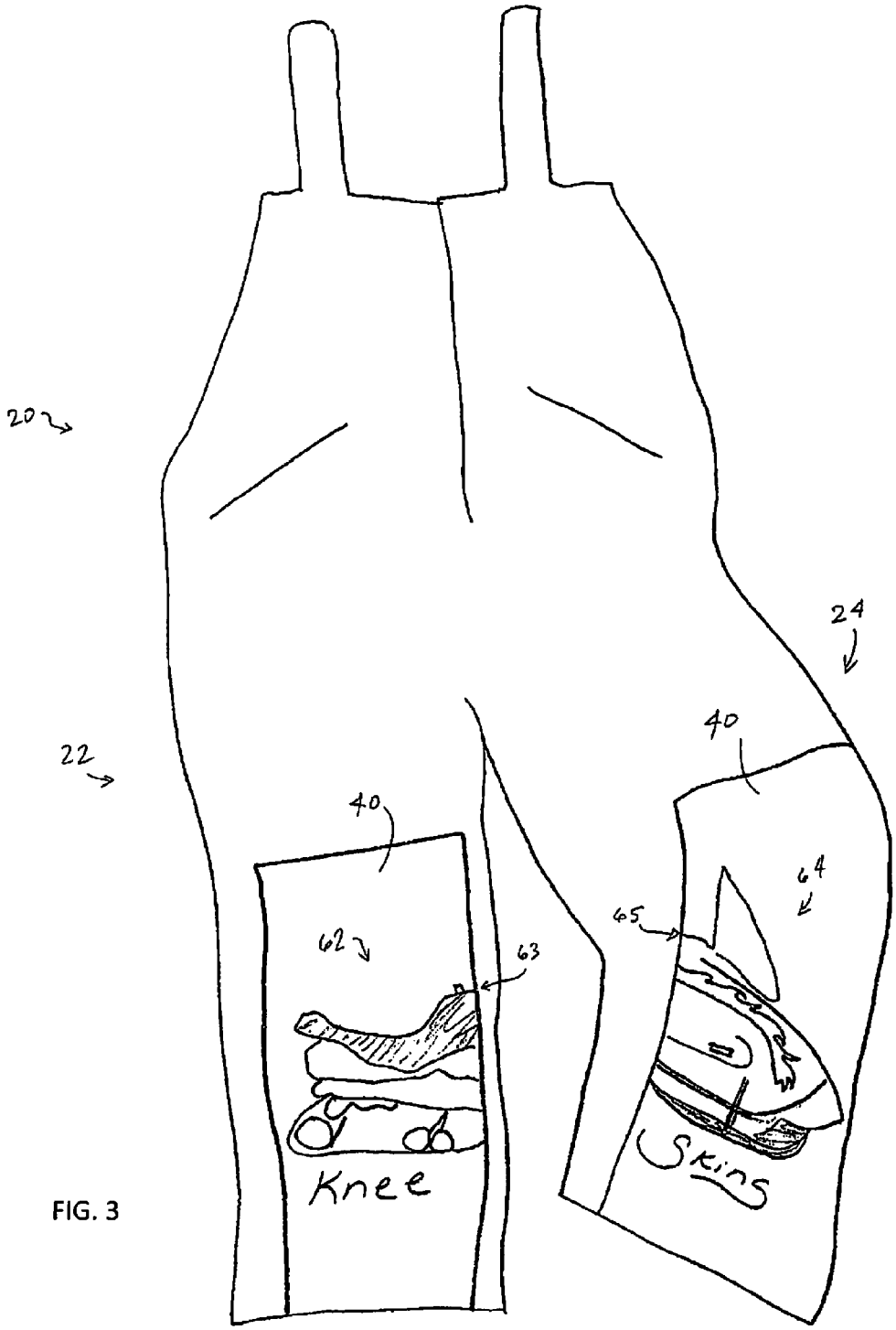
FIG. 3 is a front view of a further aspect of the invention.
Figure 4:
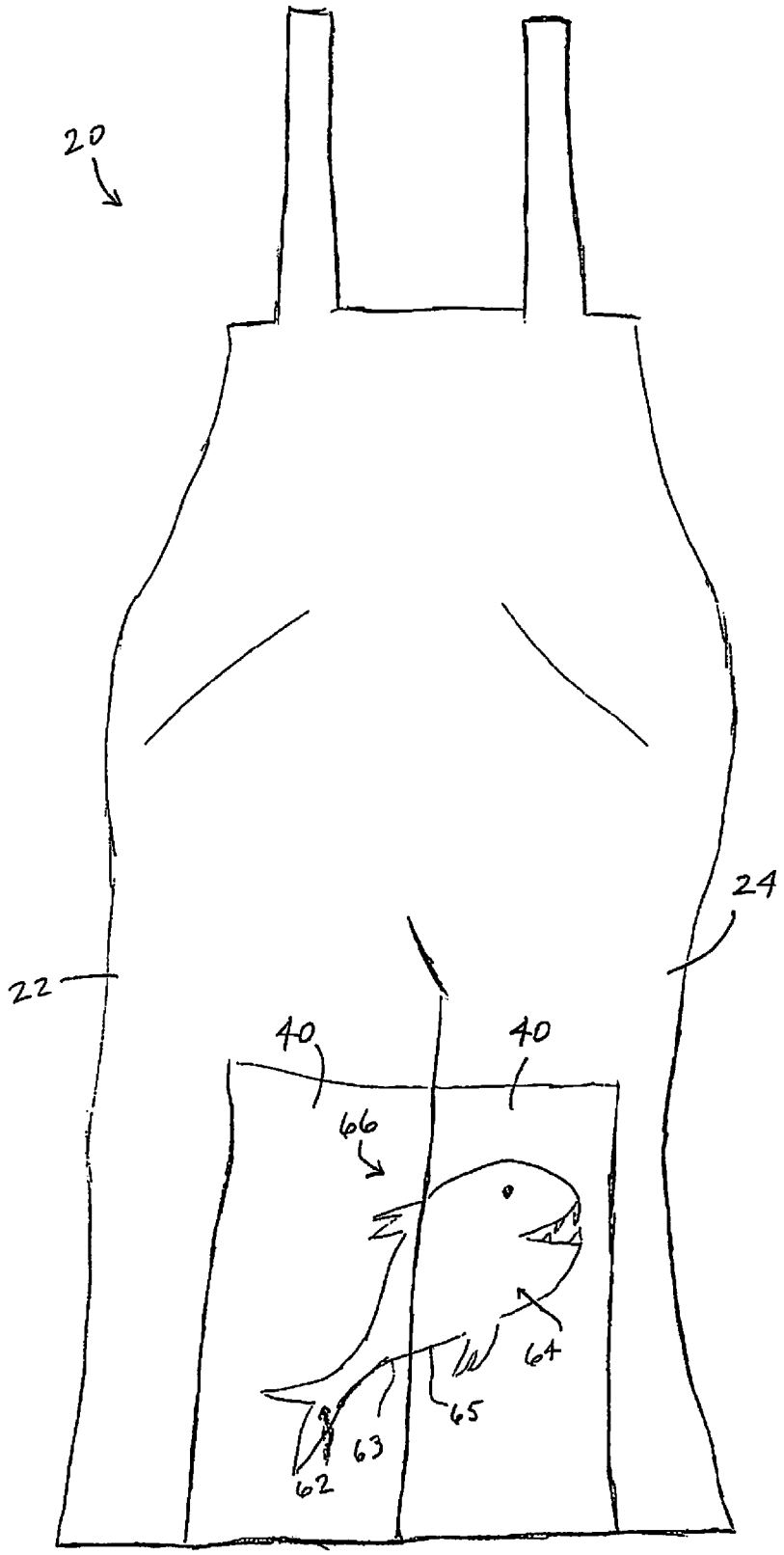
FIG. 4 is a front view of a FIG. 3 with legs positioned adjacent each other.

In a further aspect, and with reference to FIG. 3 and FIG. 4, panel 40 associated with leg 22 and panel 40 associated with leg 24 are provided. Together the panels 40, 40 depict a unitary image 66 of an object or design (i.e., two image parts are provided to create a single design image). For instance, image part 62 having a border line 63 positioned on panel 40 of leg 22 is aligned to match with image part 64 having border line 65 on adjacent panel 40 of leg 24. Particularly, when panel 40 of leg 22 is positioned next to panel 40 of leg 24, border line 63 aligns with border line 65. Such alignment creates a unitary image 66. It may be appreciated that unitary image 66 may comprise any of numerous designs, objects and text/words. In one example as shown in FIG. 3, image part 62 comprises a back end of a snowmobile unitary image 66. Image part 64 comprises a front end of a snowmobile unitary image 66. When legs 22, 24 and respective panels 40 are positioned side-by-side (as in FIG. 4), and border line 63 aligns with border line 65, unitary image 66 of snowmobile is presented.

Figure 5:
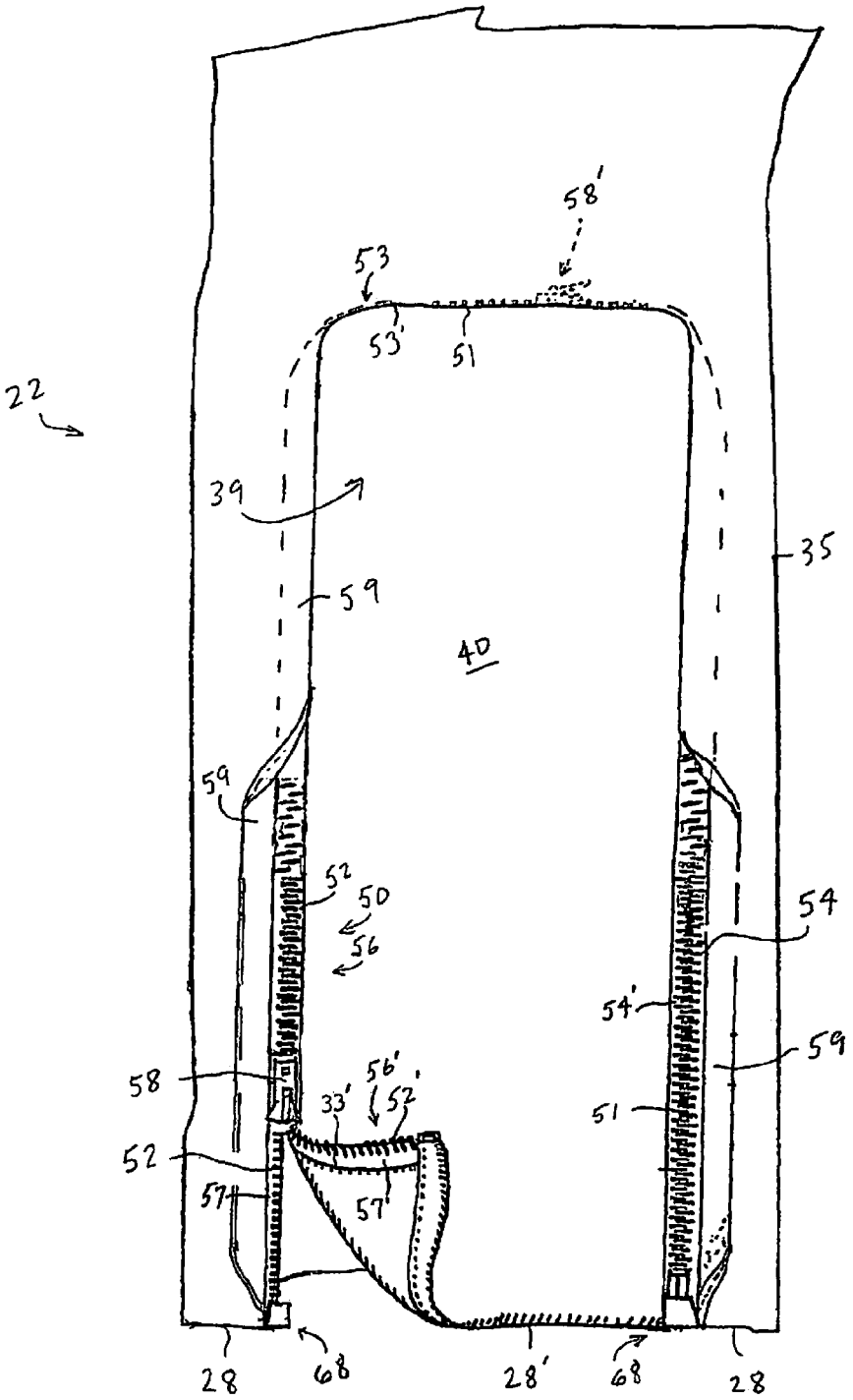
FIG. 5 is a partial front view of a further aspect of the invention.
Figure 6:
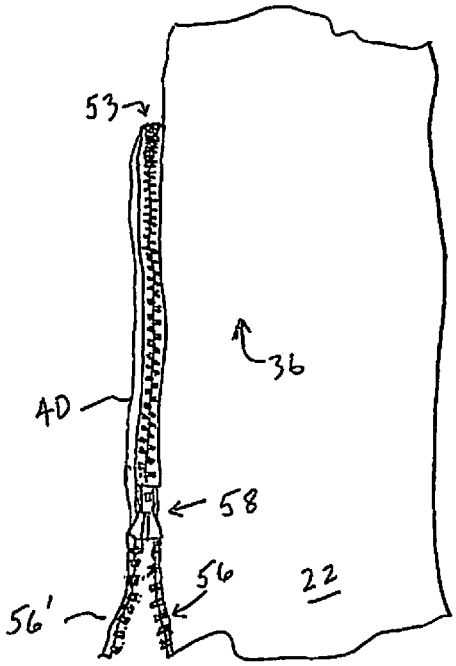
FIG. 6 is a partial side view of a further aspect of the invention.
Figure 7:
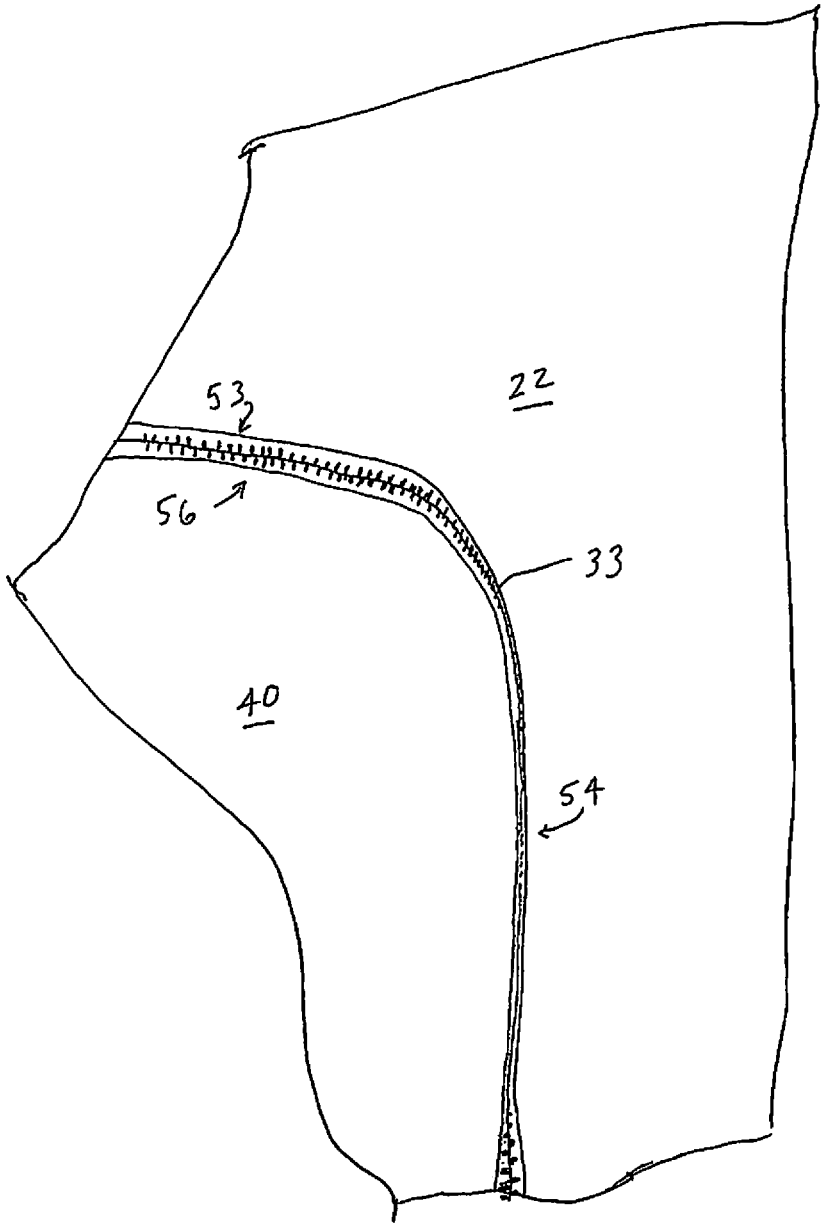
FIG. 7 is a partial front view of a further aspect of the invention.

Referring to FIGS. 5-7, further aspects of the invention are shown. It may be appreciated that fastener component 56, and zipper half 57, may be configured as a flap secured to leg 22. FIG. 5 shows first portion 52 lies flat along leg 22. Second portion 53 may also lay flat against leg 22 and also may project or flap outward (i.e., extend toward the viewer) such as shown in FIG. 5. FIG. 6 is a side view of a portion of leg 22 also showing fastener component 56. The flap 59 is removed for clarity and to show second portion 53 projecting outward. Having fastener component 56, 56' connected as flexible extension allows for component 56 (portion 52, 54) to lay flat as in FIG. 5. It may also be appreciated that portion 53 may lay flat as in FIG. 7. A flap 59 has been removed from FIG. 7 for clarity to show how slide fastener component 56 may twist at a curved area of perimeter 33. Having zipper 57 lay flat at portion 53 as in FIG. 7, while placed beneath a flap such as flap 59, lessens the exposure and profile of fastener component 56 as it spans from medial portion 36 to lateral portion 37 of leg 22.

As shown in dashed lines in FIG. 5, operating member 58' is shown at an alternative side view as it moves along zipper 57. The individual zipper teeth (or tooth) 51 are shown as operator 58 acts to connect or separate teeth 51 from adjacent teeth upon sliding. While operating member 58' may be positioned with side view orientation at portion 53, it may be appreciated that when operating member 58' is at rest at the end of fastener component 56 that operating member 58 lays substantially flat against leg 22 to limit exposure. For instance operating member 58, and fastener component 56, 56', lay flat along the vertical components of leg 22 as shown in FIG. 5 and FIG. 7.

A further aspect of the invention includes a replaceable panel 40. Panel 40 is configured to connect with leg 22 to fill gap 30. Panel 40 includes connecting means 50. Panel 40 is further configured such that upon connection to leg 22, panel includes a terminal end 28' which aligns with a terminal edge 28 of leg 22. More particularly, terminal end 28' and terminal end 28, 28, lie along a common plane. It may be appreciated that pants 20 come in a variety of shapes and sizes. In one aspect pants 20 come in a particular child size (such as small, medium, large, etc). In one aspect pants 20 of a small child size variety will have panels 40, 40 sized to match gaps 30 that are defined by legs 22, 24. A replacement panel 40, or panels 40, 40, may also be configured with a size to match gaps 30, 30, i.e., panels 40 sized for a small child size variety of pants 20. It may be appreciated that pants 20 and corresponding panels 40 may be varied to accommodate any number of variety of sizes and style.

Figure 8:
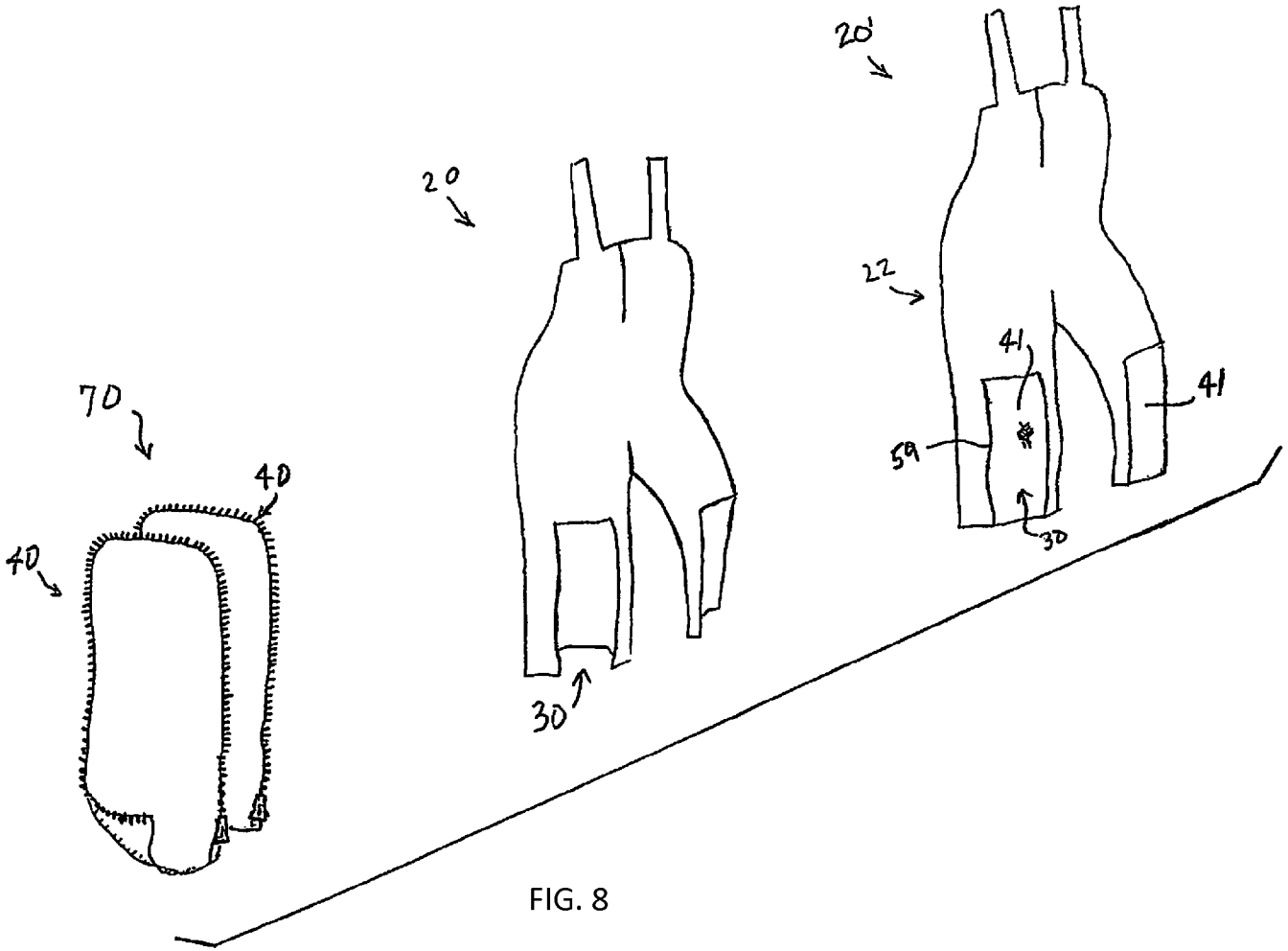
FIG. 8 is a perspective view of a further aspect of the invention.

In a further aspect, a pair of replacement panels 40, 40 may be packaged for sale as a packaged pair 70. FIG. 8 shows panels 40, 40 in a paired set with packaging removed. In a further aspect the packaged pair may be displayed in association with pants 20. A user may thus select or purchase pants 20 and a packaged pair 70 that corresponds in size with pants 20. Packaged pair 70 (or alternatively an individual panel 40) may be marked with a size and/or style that matches a size and/or style of pants 20. In this manner a user may purchase any number of packaged pairs 70 (or individual panels 40) for use and/or replacement with a single pants 20. Packaged pairs 70 (or individual panels 40) can be mixed and matched to be used with different pants 20 of the same size or style. Pair 70 or single panels 40 may come in a variety of colors and shapes and include a variety of indicia or images. A team name or logo or color scheme may be used with the pair 70, panels 40 and pants 20. A variety of leagues, team or school mascots may be used. It may be appreciated that users, including children, may swap or trade individual panels 40 (or pair 70) to mix and match any variety of combinations. A panel 40 attached to leg 22 may match or may not match, as desired, a panel 40 attached to leg 24, for instance. Panels 40 may be reversed so that a back side will face outward for a variety display, or panel 40 attached to leg 22 may be swapped with panel 40 attached to leg 24 (or swapped with a different set pants 20 altogether). If panel 40 develops a hole or is broken or undesired, the existing panel may be reversed or a new panel 40 may replace the undesired panel 40 without having to purchase a new pants 20. A user such as a child may use a single pants 20 for an entire season with several replacement panels 40 rather than purchasing several pants 20.

In an alternative aspect connecting means 50 and slide fastener component 56 may terminate prior to terminal end 28. In this aspect pants 20 may include a cuff or buffer region prior to terminal end 28. In such aspect connecting means 50 is positioned higher than terminal end 28 so that it may be better protected from contact with a ground surface. It may be appreciated that a combination of connecting means 50 may also be utilized. In one aspect a hook-and-loop, i.e., Velcro® brand material may be used in conjunction with a slide fastener such as a zipper. In one aspect a hook-and-loop component may be positioned adjacent terminal end 28 or at a cuff region of leg 22 while a slide fastener such as a zipper component may be used for the remainder for connecting panel 40 to leg 22. A hook and loop component may also be used to secure flap 59 into a flat or closed position to further conceal fastener component 56.

In a further aspect it may be appreciated that more than one fastener component 56 may be utilized in accordance with the invention. In one instance, each of first portion 52, and/or second portion 53 and/or third portion 54 may comprise separate components 56. In one aspect portions 52, 53, and/or 54 may comprise separate zippers, with portion 53 oriented transverse to portions 52, 54. In such case portion 53 may be positioned above the knee area 38 at the above-the-knee area 39. It may be appreciated that panel 40 may likewise be configured with separate fastener components 56', i.e., with separate first portion 52', and/or second portion 53' and/or third portion 54'. It may be appreciated that in one aspect component 56', when panel 40 is connected to leg 22, may terminate at a cuff region of leg 22. A flap portion 40 may nonetheless extend to align with terminal end 28. A hook-and-loop or other fastener may also be used to secure the flap portion to leg 22.

In one aspect operating member 58 may be included as part of panel 40, while in other aspects operating member 58 may be included as part of pants 20.

In a further aspect leg 22 is provided with connecting means 50 or pant slide fastener component 56 but without gap 30. In this arrangement panel 40 does not fill a gap but provides an extra layer of material or protection. Instead of removing material from leg 22 to form a gap 30, such original pant material 41 is retained. Pant material 41 is positioned at front side 21 of leg 22. As may be appreciated with respect to FIG. 8, a panel 40 may be connected to pants 20' to cover pant material 41. In such manner panel 40 protects pant material 41. Pants 20' may include connecting means 50 as described herein. It may be appreciated that pants 20' still include a gap 30 where gap 30 is defined by leg 22 and particularly defined as the space between perimeter edges of flap 59 or between perimeter edges of pant slide fastener component 56, for instance. In this aspect a back side 23 is not visible through gap 30 when looking at pants 20' from a front view. Instead, original pant material 41 is visible when looking through gap 30 from a front view. This arrangement also provides a mechanism for fashion design options, by providing panels 40 that include a desired design, color, colors, messages or the like. When the panel 40 is removed, an image or color or design placed on original pant material 41 may be visible.

A method aspect includes replacing a panel 40 of pants 20 including the step of operating an operating member 58 at a first corner area 68 of a leg 22 of pants 20 to separate the panel 40 from leg 22, the operating member 58 sliding from the first corner area 68 to a second corner area 68, and replacing the panel 40 with a second panel 40, the replacement step including sliding the operating member 58 from the second corner area 68 to the first corner area 68 to thereby connect the second panel 40 to leg 22. Sliding operating member 58 causes a panel slide fastener component 56' to engage with a pant slide fastener component 56 about a perimeter edge 33 of gap 30. Perimeter edge 33 includes at least one portion 53 which spans from a medial portion 36 to a lateral portion 37 of leg 22. In one aspect portion 53 is positioned above a knee area 38. Replacing panel 40 results in terminal end 28' of panel 40 aligning with terminal end 28 of leg 22.

A further method aspect includes a method of display of pants 20 in conjunction with panel 40 where panel 40 is presented as an accessory for use with pants 20. In a further aspect a plurality of panels 40 are presented as accessories or replacement panels 40 for pants 20 (see for instance, FIG. 8). A packaged pair 70 or multiple packaged pairs 70 may also be displayed in association with pants 20 and/or with multiple pants 20. In a further aspect a size designation of panel 40 corresponding to a size designation of pants 20 is displayed in conjunction with panel 40.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise specifically indicated. While the particular PANTS, REPLACEABLE KNEE PANELS, AND PANTS HAVING THE SAME as herein shown and described in detail is fully capable of attaining the above-described aspects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

What is claimed is:

1. Pants comprising:

at least one pant leg configured to receive a leg of a wearer, said pant leg having a generally tubular configuration and extending from a trunk portion of said pants, said pant leg defining a gap extending from an above-the-knee area of said pant leg to a terminal end of said pant leg, a backside of said leg is visible through the gap.

2. Pants comprising:

at least one pant leg configured to receive a leg of a wearer, said pant leg having a generally tubular configuration and extending from a trunk portion of said pants, said pant leg defining a gap extending from an above-the-knee area of said pant leg to a terminal end of said pant leg where said terminal end of said pant leg defines a terminal edge of said leg, the gap extending from said above-the-knee area to said terminal edge and where the gap is oriented at a front side of said pants.

3. The pants of claim 1 where said gap originates from a position above a half-way position of said pant leg, said half-way position measured along an inseam of said pant leg to be halfway from said terminal end of said pant leg to a crotch of said pant leg.

4. The pants of claim 2 further comprising a panel connected to said pant leg and filling the gap.

5. The pants of claim 4 where said panel includes a panel slide fastener component positioned at a perimeter edge of said panel.

6. The pants of claim 5 where said panel slide fastener component engages with a pant slide fastener component positioned at a perimeter edge of said gap.

7. The pants of claim 6 where at least a first portion of said pant slide fastener component is oriented generally vertically on said pant leg and at least a second portion of said pant slide fastener component is oriented generally transverse said first portion of said pant slide fastener component.

8. The pants of claim 7 where said second portion of said pant slide fastener component extends between a medial portion of said pant leg and a lateral portion of said pant leg.

9. The pants of claim 8 further comprising a third portion of said pant slide fastener component oriented generally vertically on said pant leg and generally transverse said second portion of said pant slide fastener component.

10. The pants of claim 9 where said panel slide fastener component includes a first portion configured to engage with said first portion of said pant slide fastener component, a second portion configured to engage with said second portion of said pant slide fastener component, and a third portion configured to engage with said third portion of said pant slide fastener component.

11. The pants of claim 10 where said panel further includes an operating member.

12. The pants of claim 6 where said pants slide fastener component is a zipper half and said panel slide fastener component is a zipper half.

13. The pants of claim 1 further comprising a panel and further comprising connecting means to connect said panel to said pant leg to fill the gap.

14. The pants of claim 13 where said connecting means includes a zipper.

15. The pants of claim 4 further comprising a second pant leg having a generally tubular configuration and extending from said trunk portion of said pants, said second pant leg defining a gap extending from an above-the-knee area of said second pant leg to a terminal end of said second pant leg.

16. The pants of claim 15 where said panel includes an indicia of a partial object image, said pant including an additional panel configured to connect to said second pant leg to fill said gap of said second pant leg, said additional panel including an indicia of a partial object image such that when said pant leg and said second pant leg are positioned next to each other said first partial object image and said second partial object image form a full object image.

17. The pants of claim 1 where said pant leg includes an original pant material at a front side of pant leg, said original pant material visible through said gap when viewed from a front of said pants.

18. A panel for use in conjunction with pants having at least one pant leg configured to receive a leg of a wearer, the pant leg having a generally tubular configuration and extending from a trunk portion of the pants, the pant leg defining a gap extending from an above-the-knee area of the pant leg to a terminal end of the pant leg, said panel comprising:

a pant material configured to fill the gap and defining a perimeter connecting edge and a terminal edge, said terminal edge configured to operate as a terminal edge of the pant leg, said perimeter connecting edge configured to connect to the pant leg; and a panel slide fastener component attached to said perimeter connecting edge, said fastener component spanning from a first corner area of said terminal edge to a second corner area of said terminal edge.

19. The panel of claim 18 where said perimeter connecting edge includes a first generally vertically oriented portion, a second portion oriented generally transverse with respect to said first portion, and a third generally vertically oriented portion, said slide fastener component attached to said first portion, said second portion and said third portion.

20. Snow pants comprising:

a first pant leg configured to receive a leg of a wearer, said first pant leg having a generally tubular configuration and extending from a trunk portion of said pants, said first pant leg defining a gap extending from a knee area of said first pant leg to a terminal end of said first pant leg, a backside of said first pant leg visible through the gap from a front side of said first pant leg;

a first panel configured to connect to said first pant leg and to fill the gap of said first pant leg;

a second pant leg extending from said trunk portion of said snow pants, said second pant leg defining a gap extending from a knee area of said second pant leg to a terminal end of said second pant leg, a backside of said second pant leg visible through the gap from a front side of said second pant leg; and a second panel configured to connect to said second pant leg and to fill the gap of said second pant leg.

21. The snow pants of claim 20 where the respective gaps of said first and said second pant legs originate from a position above a half-way position of said respective pant legs, said half-way position measured along an inseam of said respective pant legs to be halfway from said terminal end of said respective pant legs to a crotch of said pants, said first panel and said second panel include respective connecting means for connecting said panels to a perimeter edge of said pant legs defining respective gaps, at least a first portion of said first panel connecting means is oriented to connect a generally vertical edge of said first panel to a generally vertical edge of said pant leg defining the gap and at least a second portion of said first panel connecting means is oriented to connect an edge of said panel to an edge of said first pant leg defining the gap which edge is generally transverse said vertical edge of said first panel.

22. The pants of claim 1 where a front side of said leg is devoid of material spanning from a terminal edge of said leg to the above-the-knee area, said terminal edge positioned opposite said trunk portion.

23. The pants of claim 2 where a zipper half is connected to said leg and originates at a corner area of a lateral portion of said leg and terminates at a corner area of a medial portion of said leg.

24. The pants of claim 4 where said panel includes a perimeter edge which defines a terminal edge of said panel and a terminal edge of said pants.

25. The pants of claim 24 where said panel includes a zipper half connected to a perimeter of said panel, said terminal edge of said panel devoid of said zipper half.

26. The pants of claim 1 further comprising a panel configured to connect to said pant leg to fill the gap, said panel including an indicia.

* * * * *